US005665276A

United States Patent [19]

Kirby et al.

[11] Patent Number: 5,665,276

[45] Date of Patent: Sep. 9, 1997

[54] PROCESS FOR THE PRODUCTION OF A PYROTECHNIC OR EXPLOSIVE DEVICE

[75] Inventors: Ian John Kirby, Ayr; Graeme Allan Leiper, Prestwick, both of United Kingdom

[73] Assignee: Imperial Chemical Industries PLC, United Kingdom

[21] Appl. No.: 659,097

[22] Filed: Jun. 4, 1996

[51] Int. Cl.[6] ..... C06B 21/00

[52] U.S. Cl. ..... 264/3.1; 149/19.92; 149/109.6

[58] Field of Search ..... 149/19.92, 109.6; 264/3.1

[56] References Cited

U.S. PATENT DOCUMENTS

| | | | |
|---|---|---|---|
| 3,685,163 | 8/1972 | Olt | 149/19.92 |
| 3,819,336 | 6/1974 | Rogers et al. | 264/3.4 |
| 3,892,610 | 7/1975 | Huzonec | 149/19.92 |
| 4,177,227 | 12/1979 | Harvey et al. | 264/3.1 |
| 4,981,535 | 1/1991 | Hadermann et al. | 149/19.92 |
| 5,000,803 | 3/1991 | Hadermann et al. | 149/19.92 |

*Primary Examiner*—Edward A. Miller

[57] ABSTRACT

The invention provides an improved process for the production of a pyrotechnic or explosive device containing encased hazardous solid material wherein the material is dispersed in an inert liquid, the dispersion is formed into droplets and the droplets are solidified in a cooling medium. The solidified droplets are loaded into a casing and freeze-dried in situ in the casing to produce dry particles of the hazardous material, which may optionally be pressed within the casing, advantageously under vacuum, Only the operations (if any) subsequent to the freeze-drying need special precautions to be taken to prevent damage to personnel or equipment.

The invention is advantageous for the preparation of detonators, igniters and other devices containing hazardous materials for example lead azide, lead styphnate, pentaerythritol tetranitrate and boron/potassium nitrate mixtures.

14 Claims, No Drawings

PROCESS FOR THE PRODUCTION OF A PYROTECHNIC OR EXPLOSIVE DEVICE

This invention relates to a process for the production of a pyrotechnic or explosive device containing a hazardous solid pyrotechnic or explosive material within a casing. In this context a hazardous material is one which is capable of being ignited or detonated under circumstances which could accidently arise when the material is being handled.

The current process for the manufacture of pyrotechnic or explosive devices which contain encapsulated hazardous materials, for example igniters and detonators, involve several hazardous process steps and manufacturing conditions. Thus the mixing together of oxidizers and fuels to form pyrotechnic powders is normally a very hazardous operation, as the powders, and possibly the ingredients, are liable to be ignited by static electricity, impact, friction or heat. If subsequent granulation of the mixed powder is required, this involves further hazardous operations and also requires the inclusion of additives which would otherwise preferably be omitted.

Storage of the hazardous material in bulk form requires special explosive magazine facilities which are expensive, and are often located at a site remote from the device manufacturing site. Transfer from the magazine to the manufacturing site requires taking precautions against hazardous conditions. Usually only small batches of material can be transported and these need to be in explosion proof containers or stored in such small amounts that production of the devices is frequently interrupted, which again adds to the costs.

In the production of the devices, accurate amounts of the pyrotechnic or explosive material need to be loaded into the device casings. This hazardous operation requires very special expensive equipment. In many cases the required quantities are so small that accurate dispensing of the material cannot be achieved and the performance of the devices is adversely affected. The performance may also be affected by segregation of the ingredients of the material which can occur at every location where the material is handled, especially at the loading of the material into the casing. Moreover at each handling of the material there is a hazard from explosive dust.

The pyrotechnic or explosive material is usually pressed into the casing of the device and this is a hazardous operation requiring special equipment to protect the operators and the manufacturing equipment from the effects of accidental explosion.

In a typical pyrotechnic or explosive device such as a detonator or firework, more than one powder is needed, adding to the number of charge loading and pressing operations and consequently multiplying the hazards and costs. The hazards are further aggravated by the dust contamination from a final loading operation adding an extra hazard to subsequent loading and pressing operations.

It is an object of this invention to provide a safer method for preparing a device containing an encased charge of pyrotechnic or explosive material.

In accordance with this invention a process for preparing a pyrotechnic or explosive device containing a hazardous, solid pyrotechnic or explosive material in a casing comprises the steps of:

forming a dispersion of the ingredients of said pyrotechnic or explosive material in a sufficient quantity of inert liquid to prevent ignition or detonation of the material by impact, friction, heat or electrostatic discharge;

forming the said dispersion into droplets;

feeding said droplets into a cooling medium at a temperature below the freezing point of said inert liquid whereby said droplets are frozen into solidified droplets;

loading a charge of said solidified droplets into a casing for said pyrotechnic device;

freeze-drying said charge of solidified droplets in situ in said casing to produce particles of said hazardous material; and, optionally pressing the said particles within said casing.

In the present context an inert liquid is a non-inflammable liquid which does not react with any ingredients of the pyrotechnic or explosive material and is effective to suppress reaction of the material both in liquid and frozen form.

The inert liquid may comprise a solvent for at least one of the reactive ingredients of the pyrotechnic or explosive material, in which case the dissolution and subsequent freeze-drying of the solution of the reactive ingredient produces this ingredient in very fine microporous, crystalline form having enhanced reaction efficiency. The most preferred inert liquid comprises water and water is especially efficacious for pyrotechnic compositions which contain one or more water-soluble components.

The dispersion may be formed in a conventional manner by mixing the pyrotechnic or explosive material ingredients with the inert liquid but, if necessary to obtain a preferred viscosity for droplet formation and/or to prevent segregation of the ingredients, a thickening agent may be added to the inert liquid. If desired, other ingredients for example modifiers or fillers, may optionally be included in the dispersion. The dispersion may be conveniently formed into droplets by spraying through one or more orifices or by projection from the periphery of a rotating disc or basket. Preferred droplet diameters are in the range from 50–500 microns and more preferably 75–200 microns.

The cooling medium may be liquid, for example liquid air or liquid nitrogen, but in general, a gaseous medium is preferred in order to avoid distortion of the droplet shape. Suitable cold gases comprise air, nitrogen, carbon dioxide, argon, helium and mixtures of two or more thereof. The temperature of the cooling medium may conveniently be in the range −40° to −195° C. and preferably about −80° C. The cooling medium may advantageously be recycled through refrigeration means or cooled by a recycled refrigerated fluid in known manner.

After passing through the cooling medium the solidified droplets are substantially spherical, each droplet containing the ingredients of the pyrotechnic or explosive composition in the correct proportions uniformly dispersed in a matrix of the frozen inert liquid (which is ice when the inert liquid is water). By adjustment of the droplet forming conditions, for example the concentration of the material in the inert liquid, the spray orifice diameter, the spray pressure and the cooling medium temperature, the size distribution of the solidified droplets and the performance of the material can be controlled to ensure that the material reacts efficiently and that the flow characteristics of the material are such that it can be handled simply and accurately in the subsequent processing operations. The collected solidified droplets can, if desired, be maintained frozen indefinitely in refrigerated storage until required for further processing, since no segregation of the ingredients can occur.

When required a charge of the solidified droplets is loaded into a casing, for example a metal casing such as an igniter cup or a detonation tube, the charge being pressed if necessary. This loading operation is free from the hazard accompanying the loading of dry particulate pyrotechnic compositions. Accordingly the loading operation requires no special equipment, there is no risk to the process operators and the amount of material held in the loading feed bins need not be restricted.

Quantities of further powdered components either of the same or different composition which may be required in certain devices may be loaded into the casing using the same procedure as described above. The process of the invention is especially advantageous for preparing devices containing a very small quantity of pyrotechnic material, as the ingredients of the pyrotechnic material can be dispersed in a comparatively large amount of inert liquid so that the amount of the solidified droplets required can be sufficiently large for accurate measurement and handling.

In the freeze-drying step the encased solidified droplets are subjected in a vacuum chamber to pressure and temperature conditions at which the vapour of the inert liquid is removed from the solidified droplets by sublimation without melting the liquid in the droplets. The solidified droplets are preferably treated in a vacuum chamber maintained at a pressure below the triple point of the inert liquid, which for water is 6.11 millibar, the pressure being preferably maintained at 0.1 to 2 millibars, and are preferably heated to supply the heat of sublimation of the inert liquid and increase the vapour pressure without melting any of the constituents of the droplets. The vapour may conveniently be condensed in contact with a cold surface, leaving the freeze dried particles of pyrotechnic material.

The encased particles may advantageously be pressed in a vacuum, this operation being conveniently carried out in the same evacuated chamber in which the encased solidified droplets are freeze-dried, without removing the encased dry particles from the chamber. Pressing under vacuum condition facilitates compression of the material and eliminates the possibility of adiabatic heating.

The hazardous material remains totally safe from accidental ignition or explosion until after the freeze-drying step. Consequently only the process operations subsequent to this step, such as pressing the freeze-dried material in the casing, need be carried out with specialised equipment designed to avoid accidental explosion which could cause injury to the operators and damage the manufacturing machinery.

Devices which may advantageously be manufactured by this invention include detonators, pyrotechnic devices, igniters, pyromechanisms and propellant (gas-generating) devices which may contain, for example, hazardous ingredients comprising lead azide, sodium azide, mercury fulminate, pentaerythritol tetranitrate (PETN), lead mono- and di-nitroresorcinate, lead styphnate, barium styphnate, potassium dinitrobenzofuroxan (KDNBF), cyclotrimethylene trinitramine (RDX), and cyclotetramethylene tetranitramine (HMX), and mixtures of two or more thereof; a hazardous composition comprising such hazardous ingredients; or a hazardous composition comprising generally safe materials which become hazardous when mixed together, for example black powder, a boron/potassium nitrate mixture, a titanium/potassium perchlorate mixture, or a zirconium/potassium perchlorate mixture.

The freeze-dried hazardous material in the casing of the device may be initiated in an appropriate conventional manner, for example by flame from incendiary material or an electric bridgewire or by a shock wave from detonating fusehead or shocktube.

The invention is especially advantageous for the preparation of devices containing primary explosive compositions, for example lead azide, in very fine sensitive form which cannot safely be made and handled by conventional methods.

The invention is further illustrated by the following specific Examples wherein all parts and percentages are given by weight.

EXAMPLE 1

Manufacture of an igniter with a single pyrotechnic charge

Lead styphnate was mixed with water to form a suspension of 50% lead styphnate and 50% of water. The suspension was passed through a nozzle to form droplets with a size range from 100 to 400 microns. These droplets were frozen by directing the spray into liquid nitrogen in a dewar flask. The solidified droplets were separated from the liquid nitrogen using a sieve, and stored in a freezer held at –40° C.

160 mg of the solidified droplets were weighed directly into a tin-plated copper cup of diameter 6.73 mm, length 9.50 mm and wall thickness 0.15 mm. The solidified droplets filled the cup to a depth of 5.4 mm.

The cup was then placed under vacuum in a commercial freeze-dryer, (Edwards type) for one hour then for one hour at 70° C.

The dry powder filled the cup to a depth of 2.2 mm.

Then a glass-to-metal sealed header already positioned in the vacuum chamber and having a thin bridgewire (initiator) connected between two metal conductor pins, was pressed into the filled cup in the evacuated chamber to compress the dry powder and position the bridgewire in contact with the lead styphnate, this operation being carried out under safe conditions in which precautions were taken to protect the operatives and equipment. The pressed powder filled the cup to a depth of 0.9 mm.

During the pressing operation the metal cup was crimped firmly onto the header to complete the manufacture of an igniter.

On passing a two ampere electric current through the bridgewire the lead styphnate was ignited. The cup burst open in 750 microseconds.

EXAMPLE 2

An igniter was prepared as described in Example 1 except that barium styphnate was used instead of lead styphnate. On passing a two ampere current through the bridgewire the cup again burst in about 750 microseconds.

EXAMPLE 3

Manufacture of a protractor device (actuator)

An igniter as prepared in Example 1 was inserted into one end of a metal cylinder and held firmly in place by crimping the cylinder over the end of the igniter cup containing the header, the conductor pins being connected to leads extending outside the cylinder. A piston, which was a sliding fit in the cylinder and attached to a piston rod of much smaller diameter, was inserted into the other end of the cylinder against the end of the igniter containing the charge of lead styphnate, the piston rod extending from the cylinder end.

The end of the cylinder was crimped around the piston rod in order to retain the piston in the cylinder.

When an electrical current of 2 amperes was passed through the igniter, the piston and piston rod was pushed forwards with an impulse similar to conventional explosively operated protractor devices. The driven piston rod could be adapted to perform the usual mechanical functions of mechanical actuators for example, cutting and switching operations.

EXAMPLE 4

An igniter was prepared as described in Example 1 except that the cup was in the form of a cylindrical bellows having a wall thickness of 0.25 mm. On passing a 2 amp current through the bridgewire the bellows expanded to propel the end of the bellows axially with an impulse capable of performing the usual functions of explosively operated actuators.

EXAMPLE 5

Manufacture of an igniter with two filling materials

Two pyrotechnic powders in the form of solidified droplets were prepared as described in Example 1. The first powder contained 60% boron/potassium nitrate oxygen-balanced mixture in 40% of water and the second powder contained 40% barium styphnate in 60% of water.

A tin plated copper cup as described in Example 1 was first filled with 133 milligrams of the first powder. By gently tapping the cup the powder settled to a level surface and filled the cup to a depth of 4.6 mm. 62 milligrams of the second powder was then added to the cup. By gently tapping the cup the powder settled to a level surface, the total depth of powder now being 7.0 mm.

The powders were then freeze-dried in the cup as described in Example 1. After drying, the depth of powder was 5.3 mm. The boron/potassium nitrate powder retained its physical shape during the drying process while the barium styphnate collapsed.

A glass-to-metal sealed header was pressed into powder as described in Example 1. The depth of compressed powder was 1.5 mm.

On passing a two ampere electric current through the bridgewire, the powder was ignited and the cup burst open in 750 microseconds.

EXAMPLE 6

Manufacture of semi-conductor bridge igniter

A frozen powder consisting of 50% barium styphnate and 50% water was prepared by the procedure described in Example 1. The average particle size of the barium styphnate was 5 microns.

150 milligrams of the frozen powder was loaded into a cup as described in Example 1. The cup was tapped so that the powder surface was level, the depth of the powder being about 5.5 mm.

A glass-to-metal sealed header, having a semi-conductor bridge, connected between two metal pins, was pressed into the filled cup and crimped as described in Example 1 to complete the igniter. The pressed powder filled the cup to a depth of about 1.0 mm.

On passing an electric current of 0.75 amperes through the semi-conductor bridge the igniter cup burst open within 800 microseconds.

EXAMPLE 7

Manufacture of an electric detonator

A frozen powder consisting of 60% lead azide and 40% water, was prepared by the procedure described in Example 1.133 milligrams of the frozen powder was loaded into a 7.0 mm diameter aluminium detonator tube pre-cooled to −20° C., and having 500 milligrams of PETN already pressed into the base. The depth of the frozen lead azide powder in the cup was about 3.5 mm.

The lead azide powder was freeze-dried as described in Example 1 after which the depth of the remaining dry lead azide was about 2.0 mm.

The dry lead azide was then pressed under protective conditions, by a flat ended rod of slightly smaller diameter than the tube. The depth of the pressed lead azide (primary charge) was about 0.5 mm.

This was assembled into a conventional electric fusehead detonator which on firing, was found to be equivalent to conventional electric detonators.

EXAMPLE 8

Shock-tube initiated detonator

An aluminium detonator tube was loaded with a base charge of PETN and a pressed primary charge of lead azide as described in Example 7. An open end of a shock transmission tube (Nonel—Registered Trade Mark) was inserted into the open end of the detonator tube. On firing the shock tube the detonator fired and performed as a conventional detonator.

EXAMPLE 9

Manufacture of gas generator/propellant device

A suspension of sulphur and carbon in a solution of potassium nitrate was made by dissolving potassium nitrate in water at 50° C., and adding sulphur and carbon to the solution. The water content was 40% of the suspension. The suspension was formed into solidified droplets by the procedure as described in Example 1.

A weight of 1.67 gms of the solidified droplets was weighed into a thick walled tube of 12 mm diameter by 25 mm length, which was closed at one end by a bursting disc. The droplets filled the tube to a depth of 18 mm.

The tube was then placed in a commercial freeze-dryer, and left under vacuum at 30° C. for two hours and then at 70° C. for two hours. No change to the physical dimensions of the powder took place during the drying.

An electric fusehead igniter was inserted into the open end of the tube, so that the fusehead protruded slightly into the loose powder, conductor leads from the igniter being trained through the open end of the tube. The tube was crimped around the conductor leads.

The assembled device was placed inside a 62 liter closed pressure vessel.

On passing a one ampere electrical current through the fusehead, after a delay of about one millisecond, the pressure in the chamber was observed to rise by about 5000 Pascal's over the next 3 milliseconds.

On opening the vessel it was found that all the powder in the tube had burned.

We claim:

1. A process for preparing a pyrotechnic or explosive device containing a hazardous solid pyrotechnic or explosive material in a casing, the process comprising the steps of:

forming a dispersion of the ingredients of said pyrotechnic or explosive material in a sufficient quantity of inert liquid to prevent ignition or detonation of the material by impact, friction, heat or electrostatic discharge;

forming the said dispersion into droplets;

feeding said droplets into a cooling medium at a temperature below the freezing point of said inert liquid whereby said droplets are frozen into solidified droplets; loading a charge of said solidified droplets into a casing for said pyrotechnic device;

freeze-drying said charge of solidified droplets in situ in said casing to produce particles of said hazardous material; and, optionally, pressing the said particles within said casing.

2. A process as claimed in claim 1 wherein the inert liquid comprises a solvent for at least one reactive ingredient of the pyrotechnic or explosive material.

3. A process as claimed in claim 1 wherein the inert liquid comprises water.

4. A process as claimed in claim 1 wherein a thickening agent is added to the inert liquid.

5. A process as claimed in claim 1 wherein the cooling medium is selected from the group consisting of liquid air, liquid nitrogen, air, nitrogen gas, carbon dioxide, argon, helium and mixtures of two or more thereof.

6. A process as claimed in claim 1 wherein the temperature of the cooling medium is in the range from −40° to −195° C.

7. A process as claimed in claim 1 wherein the freeze-drying step comprises subjecting the encased solidified droplets in a vacuum chamber to pressure and temperature conditions at which the vapour of the inert liquid is removed from the solidified droplets by sublimation without melting the liquid in the droplets nor disturbing the physical integrity thereof.

8. A process as claimed in claim 7 wherein the solidified droplets are maintained in the vacuum chamber at a pressure below the triple point of the inert liquid.

9. A process as claimed in claim 7 wherein the solidified droplets in the vacuum chamber are heated to supply the heat of sublimation of the inert liquid and increase the vapour pressure without melting any of the constituents of the droplets.

10. A process as claimed in claim 1 wherein the solidified droplets are loaded into a metal casing and freeze-dried therein and optionally are pressed in the casing under vacuum conditions.

11. A process as claimed in claim 1 wherein the hazardous solid pyrotechnic or explosive material comprises one or more hazardous materials usable in a device selected from the group consisting of detonators, pyrotechnic devices, igniters, pyromechanisms and propellant devices.

12. A process as claimed in claim 1 wherein the hazardous material is selected from the group consisting of lead azide, sodium azide, mercury fulminate, PETN, lead mononitroresorcinate, lead dinitroresorcinate, lead styphnate, barium styphnate, potassium dinitrofuroxan, cyclotrimethylene trinitramine, or cyclotetramethylene tetranitramine; hazardous compositions comprising any one or more of the said hazardous materials; and hazardous compositions comprising safe materials which become hazardous when mixed together.

13. A process as claimed in claim 12 wherein the hazardous material is selected from the group consisting of black powder, boron/potassium nitrate mixtures, titanium/potassium perchlorate mixtures and zirconium/potassium perchlorate mixture.

14. A process as claimed in claim 1 wherein the pyrotechnic or explosive device is a member of the group consisting of detonators, igniters, pyromechanisms and propellant devices.

* * * * *